United States Patent [19]

Twellmann

[11] Patent Number: 5,013,106

[45] Date of Patent: May 7, 1991

[54] PLINTH DRAWER

[75] Inventor: Guenter Twellmann, Spenge-Lenzinghausen, Fed. Rep. of Germany

[73] Assignee: Ninkaplast GmbH, Bad Salzuflen, Fed. Rep. of Germany

[21] Appl. No.: 492,463

[22] Filed: Mar. 13, 1990

[30] Foreign Application Priority Data

Mar. 16, 1989 [DE] Fed. Rep. of Germany ... 8903297[U]

[51] Int. Cl.[5] ..... A47B 88/00

[52] U.S. Cl. ..... 312/330.1; 312/341.1

[58] Field of Search ..... 312/341.1, 348.4, 348.1, 312/330.1

[56] References Cited

U.S. PATENT DOCUMENTS 4,609,236 9/1986 Twellmann ..... 312/330.1

4,624,509 11/1986 Ramsey ..... 312/330 X

*Primary Examiner*—Joseph Falk

*Attorney, Agent, or Firm*—Foley & Lardner

[57] ABSTRACT

A plinth drawer comprises a bar which projects at the front upper edge and onto which a front piece attaches. The drawer also has a holder which is set back in relation to the bar, for a plinth panel. The holder is formed by two adaptors which are constructed as plastic moldings, which can be fastened to the plinth panel and which are clamped to the frame of the drawer. This construction permits simple assembly of the plinth panel and adaptation of the plinth offset to correspond to any furniture range.

19 Claims, 3 Drawing Sheets

PLINTH DRAWER

BACKGROUND OF THE INVENTION

The invention relates to a plinth drawer having a bar projecting at the front upper edge to attach a front piece and having a holder for a plinth panel.

Plinth drawers of this type are used, for example, in kitchens in the bottom cabinets of ovens and enable the free space in the bottom cabinet below the actual oven to be utilized. By utilizing the plinth area of the bottom cabinet, the drawer has sufficient depth.

The plinth drawer has in the upper region at its front side a customary front piece of a drawer which lies in a plane with the front of the bottom cabinet and with the fronts of the adjacent kitchen furniture. In contrast, in the lower region of the plinth drawer, a plinth panel is attached which is offset towards the rear in relation to the front piece and is flush with the plinth panels of the adjacent furniture.

Plinth drawers made of wood are known, in which the plinth panel is screwed onto the front wall of the actual drawer, whereas the front piece is plugged into a bar projecting forwards from the upper edge of the drawer.

In the case of customary drawers, which are not constructed as plinth drawers, there are various possibilities of adjusting at a later time the front piece in height and lateral direction in order to achieve an exact alignment with the front pieces of the neighboring parts of furniture. The mountings required for this purpose are accommodated, for example, at the front ends of the side walls of the drawer. In the case of conventional plinth drawers, in which the front piece is attached to the projecting bar, there is no adjustment possibility of this kind. Exact alignment and adjustment of the plinth panels is also relatively complicated and difficult in the case of conventional plinth drawers, especially since adaptation is often not only required in height and in the transverse direction, but also in depth, as the offset between the front piece and the plinth panel, the so-called plinth offset, varies with the furniture ranges of different makes.

SUMMARY OF THE INVENTION

The underlying object of the invention is therefore to provide a plinth drawer which, in a simple manner, can be adapted to fit in with any furniture range.

This object is achieved by providing holder means which connects the plinth panel to the frame of the plinth drawer, which can set the plinth offset in a simple manner, and which can easily and simply adjust the lateral and vertical positions of the plinth panel with respect to the remainder of the plinth drawer in a single operation.

A further object of the invention is to provide a holder that is set back from a bar projecting at the front upper edge of the drawer and onto which a front piece is attached. This holder comprises a pair of plastic adaptors which can be fastened to the plinth panel and which are clamped to the frame of the drawer.

Another object of the invention is to provide holders which include clamping slots which receive flanges of the frame which are arranged parallel to the plane of the plinth panel and which project outwardly and downwardly away from the frame. The outline of each of the adaptors is pointed in the shape of a roof at its end facing the frame, with the vertical front edge of the frame having a corresponding sloping surface. The flanges may consist of an extension of the front wall of the frame and project adjacent to the sloping surface of the frame.

In another aspect of the invention, the bar and the frame are formed as an integral plastic part, with the bar being provided with slots located in its end facing the front piece. The slots are open at one end to receive fastening screws screwed into the front piece. The bar also has openings in its rear wall to allow access to the heads of the fastening screw.

BRIEF DESCRIPTION OF THE DRAWINGS

A preferred exemplary embodiment of the invention is explained in greater detail below with reference to the drawings, in which.

DETAILED DESCRIPTION OF THE PREFERRED EMBODIMENTS

Figure 1:
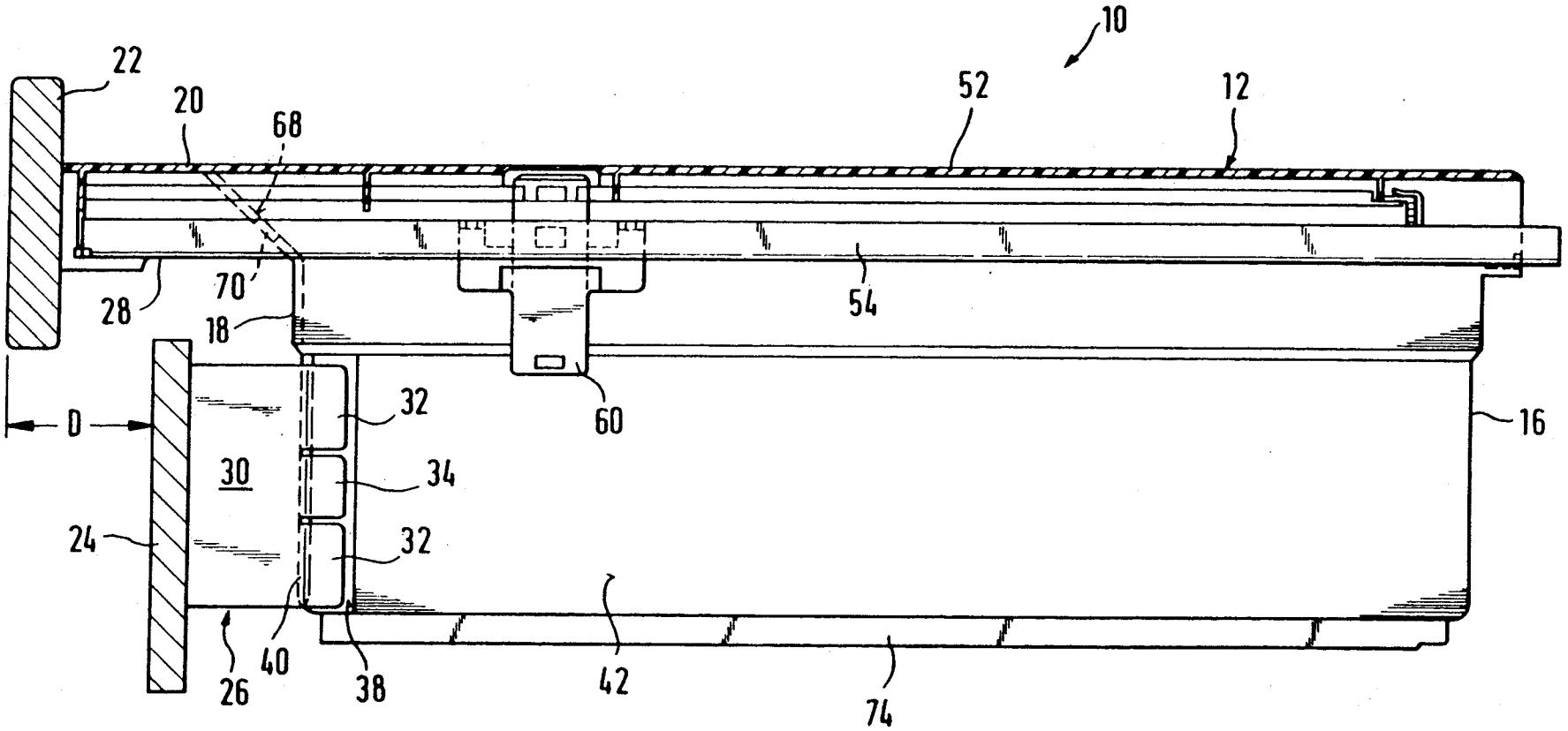
FIG. 1 shows a lateral view of a plinth drawer.

The objects of the invention are achieved in one embodiment by providing two adaptors made of plastic which can be fastened to the plinth panel to fasten the plinth panel, which adaptors are clamped to the drawer. The plinth offset can thus be set in a simple manner by using adaptors of suitable length or cutting the adaptors to a suitable length. Simple assembly is permitted by the clamp fastening of the adaptors on the drawer. The adaptors and the associated fastening devices on the drawer are concealed by the plinth panel, the front piece and the bar of the drawer such that they do not disturb its appearance.

The adaptors can be designed in such a way that they surround the front part of the actual drawer in the manner of a fork and are clamped from the outside against the side walls of the drawer. This type of fastening permits simple adjustment of the height of the plinth panel. If appropriate, the clamping force can be increased by transversely oriented clamping screws, which screws also permit the adjustment of the plinth panel in the lateral direction.

However, each adaptor is preferably provided with a clamping slot extending parallel to the plane of the plinth panel, into which slot a flange, which is attached firmly to the drawer, can be clamped. In this case, the height and lateral adjustment can be effected in one operation. Seen as an outline, the adaptor is preferably pointed in the shape of a roof at its end facing the drawer, and the drawer is provided at its front vertical edges with slants which correspond to the sloping surfaces of the roof-shaped regions of the adaptors. The adaptors, seen from the front, thus each lie half inside and half outside the cross section of the drawer. The clamping slots of the adaptors are situated at the transition point between the roof-shaped region and the main part of the adaptor and each receive a flange which projects laterally as an extension of the front wall of the drawer. The roof-shaped part of the adaptor forms a clamping tongue which can be clamped against the flange by means of a screw which is accessible from the outer sloping surface of the adaptor. The screws to fasten the adaptor to the plinth panel are likewise accessible from this sloping surface and extend into the parts of the adaptor lying outside the cross section of the drawer. This design of the adaptors and the clamping fastenings results in simple assembly and compact construction, and sharp corners in the transition area between the drawer and the adaptor, which might cause injury, are avoided.

According to a further aspect of the invention the bar serving to fasten the front piece of the drawer and the drawer frame are made in one piece of plastic and the bar is provided at its front wall facing the front piece with at least two slots, which are open at one end, to receive fastening screws screwed into the front piece. Constructed in the rear side of the bar facing the inside of the drawer are openings, through which the heads of the fastening screws are accessible. In this manner, a simple, detachable fastening of the front piece is permitted and, owing to a certain play of the fastening screws in the slots, the front piece can be adjusted laterally and in height. The bar preferably has at its rear side a sloping surface inclined from the upper edge to the inside of the drawer, in which sloping surface the openings for the fastening screws are situated. By reason of the sloping surface, the fastening screws can be reached more easily by a screwdriver and, additionally, a both optically and functionally favorable transition between the bar and the inside of the drawer is achieved by the sloping surface. The open ends of the slots for the fastening screws are preferably restricted by catches such that the front piece engages on the bar with screwed-in fastening screws and can be held provisionally as long as the fastening screws have not been tightened.

Figure 2:
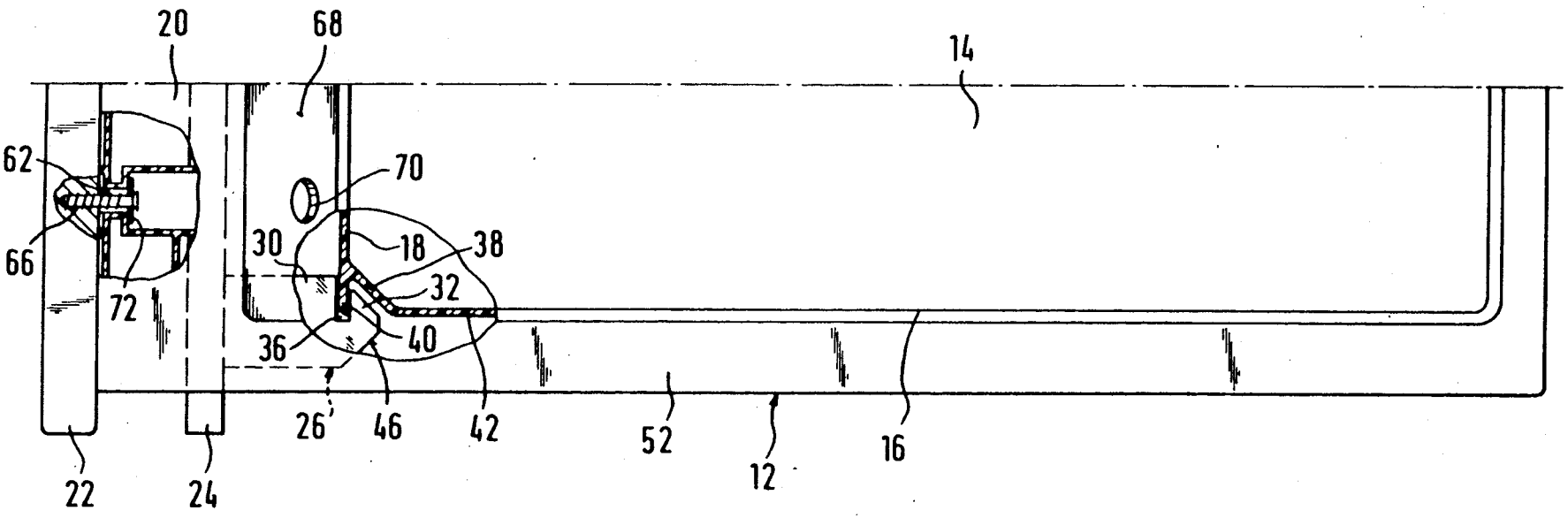
FIG. 2 shows the lateral edge region of the plinth drawer in the plan view.

According to FIGS. 1 and 2, the plinth drawer 10 has an integral plastic shell 12 which forms both the base 14 and the frame 16 of the drawer. Constructed at the upper end of the front wall 18 of the frame is a bar 20 projecting horizontally forwards, to which a front piece 22 is fastened. A plinth panel 24 is fastened below and set back from a front edge of the bar 20 to the front corners of the frame 16 with the aid of two adaptors 26 constructed as plastic moldings. Sufficient free space to attach the plinth panel 24 is formed by a slight bend 28 at the lower side of the bar 20.

Figure 5:
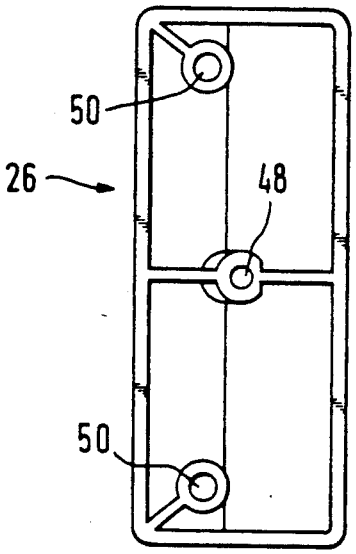
FIG. 5 shows a front view of the adaptor.

Each of the adaptors 26 has a uniform, approximately rectangular profile in its main part (FIG. 5) and can thus be cut off to set the plinth offset D, defined by the distance between front piece 22 and plinth panel 24, as shown in FIG. 1, to any desired length. At its end facing the frame 16, the outline of the adaptor 26 is pointed in the shape of a roof. Both sides of the roof-shaped part slant outwardly from the upper end and terminate at the base thereof. The roof-shaped or slanted region is divided by horizontal slots into upper and lower holding parts 32 and a central clamping part 34. Together with the main part 30 of the adaptor, the holding and clamping parts bound a clamping slot 36 which opens towards the front wall 18 of the frame.

The frame 16 has at each of its front vertical edges a sloping surface 38 which, like the sloping surfaces of the roof-shaped region of the adaptor, forms an angle of 45° with the longitudinal axis of the drawer. Constructed on the frame 16 is a flange 40 projecting laterally as an extension of the front wall 18, the free end of which flange is flush with the side wall 42 of the frame. By engaging the flange 40 in the clamping slot 36, the adaptor 26 is clamped to the frame 16. The distance between the adaptors 26 attached to the two ends of the plinth panel 24 is dimensioned in such a way that the flanges 40 have a certain play in the direction of the depth of the clamping slots such that the plinth panel 24 can be adjusted both in the lateral direction and in the vertical direction.

Figure 3:
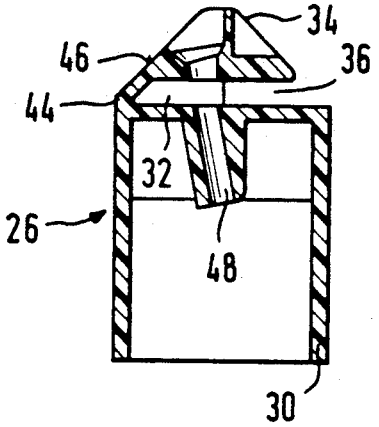
FIGS. 3 and 4 show sections through an adaptor to fasten a plinth panel.

According to FIG. 3, the clamping slot 36 of adaptor 26 has a relatively great depth in the region of the clamping part 34 such that the clamping part is only connected resiliently to the main part 30 of the adaptor via a relatively thin wall 44. A screw channel 48 oriented obliquely leads into the inside of the adaptor from the sloping surface 46 of the clamping part 34 which is on the outside in relation to the drawer. By means of a screw screwed into the screw channel 48, the clamping slot 36 can thus be restricted in such a way that the flange 40 is firmly clamped. The flange 40 of frame 16 is secured against displacement relative to the adaptor 26 by means of grooves (not shown) on the flange 40 and on the inner surfaces of the clamping slot 36. The grooves are preferably oriented horizontally at least with one of the adaptors. In contrast, vertical grooves can be provided on the other adaptor such that simple and exact adjustment is permitted both in height and in a lateral direction.

Figure 4:
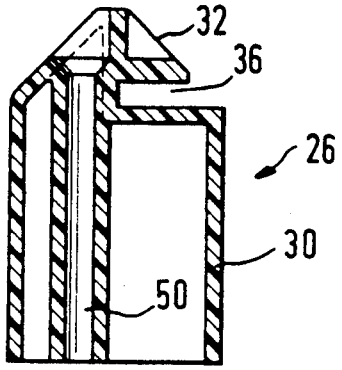

According to FIG. 4, the holding parts 32 are connected essentially rigidly to the main part 30 of the adaptor as the clamping slot 36 in this case only reaches approximately up to the central plane of the adaptor. By means of the holding parts 32 arranged on both sides of the clamping part 34, the clamping part 34 is protected from damage in the case of more severe loading of the clamping connection. In that half of the adaptor, which is not interrupted by the clamping slot 36, a screw channel 50 for a screw to fasten the adaptor to the plinth panel 24 is constructed in the region of each of the holding parts 32, which screw channel extends parallel to the longitudinal axis of the adaptor.

During assembly of the plinth panel 24, the adaptors 26 are firstly screwed at a suitable distance to the rear side of the plinth panel 24 and, subsequently, the adaptors 26 are plugged onto the flanges 40 of the frame 16 from below.

Figure 6:
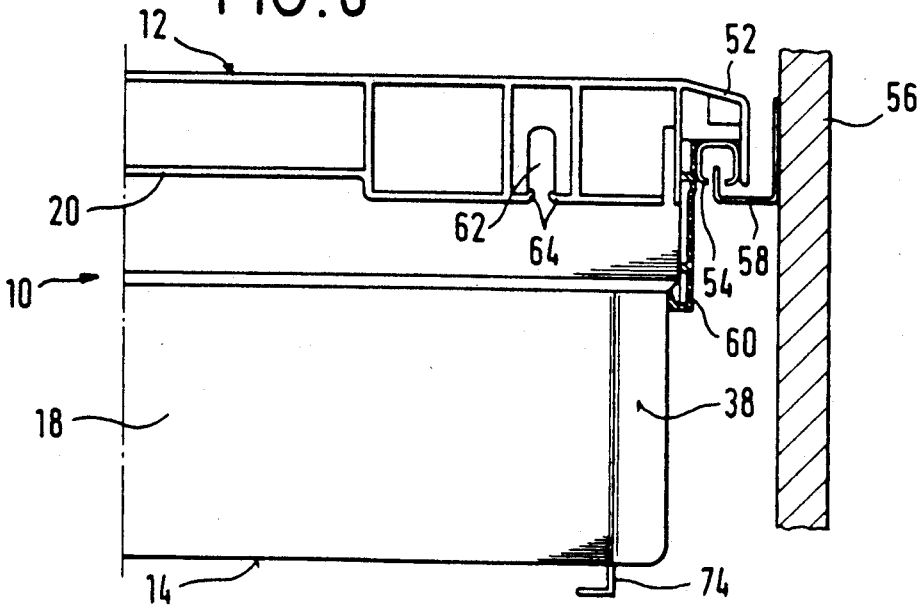
FIG. 6 shows a front view of the drawer without the front piece and the plinth panel.

According to FIG. 6, the frame 16 has at the upper edge a flange 52 which extends approximately horizontally and is angled downwards at the outer end, which flange forms a channel at the longitudinal sides of the frame to receive a sliding rail 54. The sliding rail 54 is conducted on a running rail 58 fastened to a wall 56 of the furniture body. The sliding rail 54 is engaged on the plastic shell 12 of the drawer by means of a holding tongue 60. As can be seen in FIG. 2, although the adaptor 26 lies partially outside the plane of the side wall 42 of the frame, thereby forming an extension of the side wall, it is still inside the outer edge of the drawer formed by the free end of the flange 52.

Constructed in the end face of the bar 20, according to FIG. 6, are vertical slots 62 which may be slightly restricted at their lower end by catches 64, but are otherwise open. Screwed into the front piece 22, according to FIG. 2, are fastening screws 66 which can be passed between the catches 64 by overcoming a certain resistance and introduced into the slots 62.

On the rear side of the bar 20, the plastic shell 12 forms a sloping surface 68 inclined towards the front wall 18 of the frame. The heads of the fastening screws 66 are accessible through openings 70 which are formed in the sloping surface and which can be sealed by means of plugs. The screws 66 are provided in each case with a washer 72 and have a certain play in the slots 62 such that the front piece 22 can be adjusted both in height and in the lateral direction.

With the drawer described above, both the plinth panel 24 and the front piece 22 can thus be assembled and adjusted in a simple manner.

Molded onto the underside of the base 14 of the plastic shell 12 are angled strips 74 into which a reinforcing chipboard base can be inserted Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A plinth drawer comprising:

(a) a frame;

(b) a bar projecting from a front upper edge of said frame;

(c) a front piece attached to said bar;

(d) a plinth panel; and (e) a holder for connecting said plinth panel to said frame, said holder being set back in relation to at least a portion of the bar, said holder being formed by two adaptors constructed as plastic moldings which are clamped to said frame and which are removably fastened to said plinth panel.

2. The plinth drawer as claimed in claim 1, wherein the adaptors each have a uniform profile at an end section facing said plinth panel and can be cut to a length corresponding to a desired plinth offset.

3. The plinth drawer as claimed in claim 1, wherein each adaptor has a clamping slot which receives a respective flange constructed on the frame of the plinth drawer.

4. The plinth drawer as claimed in claim 3, wherein the flanges are arranged parallel to the plane of said plinth panel and project outwards and downwards away from said frame.

5. The plinth drawer as claimed in claim 1, further comprising:

side walls of said frame, said adaptors being positioned with respect to said side walls in such a manner that a part of their respective cross sections projects laterally beyond the associated side wall to form an extension of the side wall.

6. The plinth drawer as claimed in claim 5, wherein said frame has at its upper edge a flange projecting outwards and angled downwards, which on each side of the frame forms a channel to receive a sliding rail, and wherein the parts of the adaptors projecting beyond the side walls lie within cavities formed below the sliding rails within the outline of the flange.

7. The plinth drawer as claimed in claim 5, wherein the outline of each of said adaptors has an end facing the frame which comprises a pair of sides which are slanted towards one another at upper ends thereof, and wherein the frame has at its vertical front edge a sloping surface corresponding to the slant of the adaptor.

8. The plinth drawer as claimed in claim 3, wherein:

(a) the flanges are arranged in parallel to the plane of the plinth panel and project outwardly and downwardly away from said frame and each of the adaptors has an end facing the frame which comprises a pair of sides which are slanted towards one another at upper ends thereof;

(b) the frame has at its vertical front edge a sloping surface corresponding to the slant of the adaptors;

(c) the clamping slot of each adaptor is arranged at the base of the roof-shaped part; and (d) the flange engaging the clamping slot of each adaptor projects adjacent to the sloping surface of said frame as a projection of a front wall of said frame.

9. The plinth drawer as claimed in claim 3, wherein the clamping slot of each adaptor is bounded on one side by two holding parts which are connected rigidly to a main part of the adaptor and a clamping part which is arranged between the holding parts and which is connected resiliently to the main part of the adaptor.

10. The plinth drawer as claimed in claim 9, further comprising a screw channel extending obliquely through the clamping part and the main part of the adaptors.

11. The plinth drawer as claimed in claim 9, which comprises further screw channels, extending through each adaptor in the region of the holding parts outside the clamping slot over the entire length, for receiving screws to fasten the adaptor to the plinth panel.

12. The plinth drawer as claimed in claim 11, wherein the bar and the frame are formed as an integral plastic part, and wherein the bar is provided with slots located on its end face facing the front piece, which slots are open at one end to receive fastening screws screwed into the front piece, the bar also being provided with openings in its rear wall facing the inside of the plinth drawer, which openings allow access to the heads of the fastening screws.

13. The plinth drawer as claimed in claim 12, wherein the rear wall of the bar is inclined from the upper side of the bar to the inside of the drawer.

14. The drawer as claimed in claim 12, wherein the openings in the rear wall of the bar are sealed by detachable plugs.

15. The plinth drawer as claimed in claim 12, wherein the slots are oriented vertically in the front wall of the bar and are penetrated with play by the fastening screws.

16. The plinth drawer as claimed in claim 15, wherein the slots are restricted by catches at their open end.

17. A plinth drawer comprising:

(a) a frame;

(b) a bar projecting from a front upper edge of said frame;

(c) a front piece attached to said bar;

(d) a plinth panel; and (e) holder means for attaching said plinth panel to said frame, wherein said holder means is adjustably attachable to said frame to provide for lateral and vertical adjustment of the plinth panel with respect to the frame in a single operation, and wherein said holder means is adjustable so as to set a depth between the front piece and the plinth panel to a desired value for a given application of said plinth drawer.

18. The plinth drawer as claimed in claim 17, wherein said holder means comprises two adaptors which are constructed as plastic moldings.

19. The plinth drawer as claimed in claim 18, wherein:

(a) each adaptor has a clamping slot which is received in a flange constructed on the frame of the plinth drawer;

(b) the flanges are arranged in parallel to the plane of the plinth panel and project outwardly and downwardly away from said frame, and each of the adaptors has an end facing the frame which comprises a pair of sides which are slanted towards one another at upper ends thereof;

(c) the frame has at its vertical front edge a sloping surface corresponding to the slant of the adaptors;

(d) the clamping slot of each adaptor is arranged at the base of the roof-shaped part; and (e) the flange engaging the clamping slot of each adaptor projects adjacent to the sloping surface of said frame as a projection of a front wall of said frame.

* * * * *